US005595572A

United States Patent [19]

Millington

[11] Patent Number: 5,595,572

[45] Date of Patent: Jan. 21, 1997

[54] WOOL AND WOOL-BLEND FABRIC TREATMENT

[75] Inventor: Keith R. Millington, Belmont, Australia

[73] Assignee: The Commonwealth of Australia Commonwealth Scientific and Industrial Research Organization, Campbell, Australia

[21] Appl. No.: 505,233

[22] PCT Filed: Feb. 15, 1994

[86] PCT No.: PCT/AU94/00066

§ 371 Date: Aug. 16, 1995

§ 102(e) Date: Aug. 16, 1995

[87] PCT Pub. No.: WO94/19526

PCT Pub. Date: Sep. 1, 1994

[30] Foreign Application Priority Data

Feb. 16, 1993 [AU] Australia ..... PL7272

[51] Int. Cl.[6] ..... D06M 10/04; D06L 3/02; D06L 3/04

[52] U.S. Cl. ..... 8/103; 8/107; 8/111

[58] Field of Search ..... 8/103, 107, 111

[56] References Cited

U.S. PATENT DOCUMENTS

| | | | |
|---|---|---|---|
| 2,161,045 | 6/1939 | Hirschkind et al. | 8/103 |
| 3,927,967 | 12/1975 | Speakman . | |
| 4,445,901 | 5/1984 | Beavan et al. | 8/103 |
| 4,460,373 | 7/1984 | Beavan | 8/103 |
| 4,668,418 | 5/1987 | Ricchiero | 8/103 |
| 5,407,446 | 4/1995 | Sando et al. | 8/103 |

FOREIGN PATENT DOCUMENTS

| | | |
|---|---|---|
| 92/15744 | 9/1992 | European Pat. Off. . |
| 3619694 | 11/1986 | Germany . |
| 4-41768 | 2/1992 | Japan . |
| 727771 | 9/1952 | United Kingdom . |
| 811702 | 7/1954 | United Kingdom . |

OTHER PUBLICATIONS

Derwent Abstract Accession No. 92–331776/40, class F06, WO.A. 92/15744 (Lappage J) 5 Mar. 1991.

Derwent Abstract Accession No. 91–204889/28, class A35, JO.A. 3130–463 (Toy Obokk) 4 Jun. 1991.

Journal of the Textile Institute, vol. 55, Leeds, GB, pp. T136–T145. F. O. Howitt "The Yellowing of Wool: a Survey of the Literature." date unavailable.

*Primary Examiner*—Jacqueline V. Howard
*Attorney, Agent, or Firm*—Lowe, Price, LeBlanc & Becker

[57] ABSTRACT

The invention relates to a method of modifying the surface of a fabric which comprises the successive steps of: i) exposing the fabric surface to UV radiation; and ii) oxidative treatment of the fabric.

14 Claims, 4 Drawing Sheets

Low pressure Hg arc, 0.1 W/cm

Low pressure Hg arc, 0.1 W/cm

Medium pressure Hg arc, 120 W/cm

ASTM random tumble test D3512-82

ASTM random tumble test D3512-82

WOOL AND WOOL-BLEND FABRIC TREATMENT

The present invention relates to wool and wool blend fabric treatments and in particular to novel methods of treating fabrics to give good colour yields when printed and/or to reduce pilling.

BACKGROUND

Wool and wool-blend fabrics have been processed and treated for many years to improve and/or enhance a wide range of characteristics. For example, the pre-treatment of fabrics, such as wool, before printing is essential to achieve good colour yields, levelness and brightness. Similarly a range of processes and treatments have been proposed to reduce or eliminate pilling.

Traditionally, chlorination has been used and several variants of the chlorination process are still used almost exclusively to prepare wool fabrics for printing. Dichloroisocyanuric acid (DCCA) is the most common chlorination reagent currently in use, and can be applied by both batch (the most common) and continuous processes. The batch method involves chlorination with 3–4% DCCA on mass of fibre (omf), at pH 3.5–4.5 and a temperature of 20°–40° C. for about 1 hour, followed by an antichlor aftertreatment with sodium bisulphite and acetic acid. The continuous process involves padding DCCA (35–50 $gl^{-1}$), followed by a dwell time of 2–5 minutes before rinsing and an antichlor treatment similar to the batch process. The alternative to DCCA is Kroy chlorination, originally introduced for treatment of wool tops, which uses a solution of chlorine gas in water in a continuous fabric treatment process. Chlorine reacts with water to give a mixture of hypochlorous and hydrochloric acids, which is sprayed directly onto the fabric with a wetting agent. The reaction is more rapid than DCCA, but a rinsing and antichlor treatment are still necessary. Processing speeds of 10–15 m $min^{-1}$ at a chlorine dose rate of 4% omf are typical and give similar performance to fabrics treated with 4% DCCA.

Typical problems with fabric chlorination include: yellowing, achieving an even application, and fibre damage. It is also very often necessary to bleach chlorine-treated fabrics, usually with hydrogen peroxide, to remove yellowness before printing. However, it is the environmental pressure on processes involving chlorine, particularly when absorbable organohalogens (AOX) are present in the plant effluent, which is leading to the replacement of chlorination by alternative technologies.

Other methods used to treat fabrics prior to printing are not common. Two polymer treatment routes, one for top and one for fabric are currently known, they are:

1. Hercosett 125 (trade name)

This polymer is applied to wool top after a prechlorination stage. Fabrics produced from treated top have an increased affinity for anionic dyes. The further mechanical processing which occurs during gilling, spinning and weaving results in a level preparation. However the colour yields tend to be lower since less chlorine is used. Further, care must be taken in washing off since treated wool has a high affinity for loose anionic dyes.

2. Synthappret BAP (trade name)

This polymer may be applied to a fabric without the need for a prechlorination step. The treatment of fabrics with this polymer prior to printing provides the fabric with a high affinity for hydrophobic dyes. However, the lack of a chlorination step reduces the penetration of printing paste into the fibres, and control over the steaming conditions is critical. This method has been used to print wool/cotton blends, but not pure wool fabrics to date.

Other methods avoiding the use of chlorine have been developed but are not considered to be commercially viable despite their reduced environmental impact. To summarise, the only prior art methods widely used commercially for pretreating wool fabrics for printing involve chlorination, followed by rinsing and an antichlor treatment, which then may require a bleaching treatment to remove yellowness.

Pilling is a term used to describe the formation of small, tight balls of fibre on a fabric surface. Pilling is highly detrimental to garments, resulting in a worn and unkempt appearance, and is a particular problem for knitwear.

The pilling process is complex but can be described as four successive stages:

(i) Fuzz Formation. The mild rubbing action which occurs during wear teases some surface fibres from their parent yarns, resulting in a fuzzy surface.

(ii) Fuzz Entanglement. Areas of the garment which are subjected to more frequent rubbing develop the higher fuzz densities. Fibres in such areas become entangled at some stage to form loose balls.

(iii) Pill Formation and Growth. Continued rubbing on loose entanglements causes some to roll into tighter balls. These tight balls resist further rubbing forces, and some of the weaker fibres in the pills break. The stronger fibres remain intact and anchor the pills to the fabric surface. Pills grow as they pick up loose fibres from the fabric surface.

(iv) Pill Wear-Off. The anchor fibres finally succumb to the steadily increasing forces acting on the pill and undergo fatigue failure. As each anchor fibre breaks, those remaining have to withstand larger forces and the rate of anchor failure thus accelerates. Pill removal occures when the rate of anchor fibre breakage exceeds the rate of pill growth.

The nature of the fibres (origin, processing history, physical dimensions), the yarn (type, twist) and the fabric structure are all important factors in pilling. In wear there are other variables which can influence the rate of pilling. It is well known that some wearers produce more rapid and extensive pilling than others. Laundering can substantially alter pilling performance. Subjective differences between individuals also exist over how objectionable a given amount of pilling is.

Several chemical treatments are known to reduce pilling, although as yet no process can guarantee zero pilling in wear. For example, the oxidative chlorination processes commonly used for shrinkproofing have some beneficial effect. Chlorine/Hercosett and certain other polymer treatments which inhibit fibre migration by forming inter-fibre bonds, are also beneficial. More damaging dyeing conditions (i.e. long boiling times, high temperatures, extremes of pH) also tend to reduce pilling.

Similar to printing pretreatments there is currently a great deal of environmental pressure against the use of processes which use chlorine, particularly when adsorbable organohalogens (AOX) are produced in plant effluent. Hence it is likely that the partially-effective anti-pilling treatments and printing pre-treatments which involve chlorine compounds will be phased out within the next ten years or so.

Applicant has now surprisingly found that the combination of subjecting a fabric to UV radiation followed by oxidative bleaching provides a synergistic mechanism to effectively increase the ability of the fabric to give good colour yield when printed and reduce the likelihood of pilling.

Extensive investigations involving the use of either UV radiation or oxidative bleaching alone established that the single steps were ineffective in increasing colour yields or reducing pilling significantly. It was also established that the oxidative bleaching step must follow the irradiation, and cannot be applied first or during irradiation while wet. It was found that high, even colour yields, better than those produced by 4% DCCA, were achieved using the two-step procedure over a range of classes of dye.

Most research on the effects of UV on wool has been aimed at limiting the long-term negative effects such as photoyellowing, phototendering and the fading of dyed wool. Previous work on the positive application of UV radiation ($\lambda$<400 nm) in the treatment of wool fabrics appears to be limited to two commercial patents.

U.K. Patent 811702 describes the use of ultraviolet radiation for modifying the rate of dye uptake of wool fabrics. This increases the colour yields of exposed fabric, depending on the nature of the dye used. Use of suitable stencils during irradiation, followed by use of a dye resist agent to partially protect unirradiated areas of fabric during dyeing, can produce good tone-on-tone effects. This document also discloses that in the interest of shortening the period of irradiation it is advantageous to treat the fabric with an oxidising agent during UV exposure. However, this document does not describe or suggest the possible application of irradiation to fabric printing, or the method of oxidative bleaching of the fabric after subjecting the fabric to irradiation. In fact, the U.K. patent stresses the use of an oxidising agent during UV exposure to shorten the period of irradiation rather than as an essential, discrete step in a synergistic process to increase the affinity of the fabric to dyes.

Japanese Patent H4-41768 claims that UV exposure alone is an effective shrinkproofing treatment for wool fabrics. However the claimed large reductions in fabric area shrinkage have not been reproduced in our studies. This could be due to the nature of the wool fabric used by the Japanese workers, or because their felting procedure was less severe than ours.

SUMMARY OF THE INVENTION

In particular, the present invention provides a method of modifying the surface of a fabric which comprises the successive steps of:

(i) exposing the fabric surface to UV radiation; and (ii) oxidative treatment of the fabric.

In the first step of the method of the invention the fabric may be irradiated by ultraviolet light from any suitable source. Preferably the fabric is subjected to ultraviolet radiation in the preferred range of 400–180 nm. More preferably the fabric is subjected to short-wavelength UV radiation (UV-C) having a wavelength of 280–200 nm and yet even more preferably having a wavelength near the absorption maximum of the disulphide bonds in wool (approximately 254 nm).

BRIEF DESCRIPTION OF THE DRAWINGS

Reference is now made to the drawings accompanying the application wherein.

Figure 1:
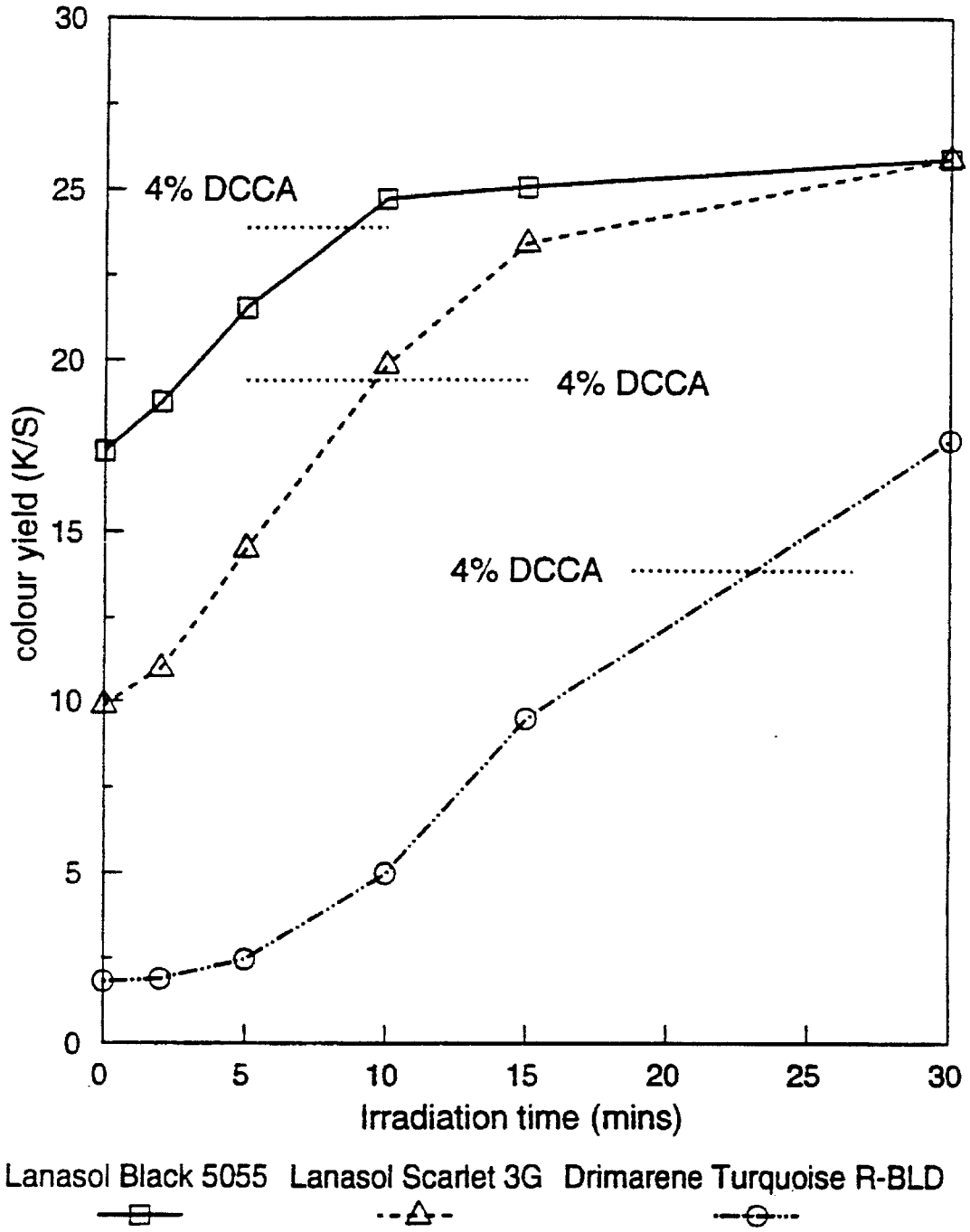
FIG. 1 is a graph comparing color yield with radiation time for UV-treated/peroxide bleached fabrics.

The UV radiation may be provided by any suitable source. The source selected will depend on the intensity and wavelength of irradiation to be used in the method. Preferred sources of radiation for ultraviolet radiation include low; medium-and high-pressure mercury arcs, and xenon discharge tubes. In a preferred embodiment of the invention a low-pressure mercury arc, producing 85% of emitted UV at 254 nm, may be used.

The length of time for which the fabric is irradiated will depend upon the intensity and wavelength characteristics of the radiation source and the desired result. Depending on the source of radiation, the length of time required may range from a few seconds to 2 hours. For example, with a low intensity UV source, such as a low pressure mercury arc, irradiation times of 30–50 minutes may be required. With a suitable medium or high-pressure mercury arc of high UV intensity (typically 120 W $cm^{-1}$), irradiation times of a few seconds may be sufficient. Using a suitable elliptical or parabolic reflector to focus the UV radiation from a tube into a narrow strip or parallel beam allows fabric to be treated continuously, and this is clearly the most suitable commercial method for exposing large pieces of fabric. Alternatively a continuous irradiation process could be used to treat individual garments or lengths of fabrics for dyeing.

After UV exposure, the colour of the wool or wool-blend fabrics change from pale cream to pale olive-green, and this colour changes over an hour or so in room air to a pale yellow. Measurement by any conventional method of the yellowness of fabrics irradiated with UV-C after standing for 24 hours can be used to assess the degree of surface modification.

In the second step of the invention the fabric may be oxidised by any suitable treatment. For example, it may be oxidised by using any suitable oxidant such as hydrogen peroxide or permonsulphuric acid (PMS). In a preferred embodiment, the fabric is bleached using hydrogen peroxide. Preferably a solution of approximately 0.75% w/w hydrogen peroxide having a pH in the range 8–9 is used. The time period required for bleaching will be dependent upon the type of fabric and oxidant used and the desired result. The oxidant may be stabilised by any suitable stabiliser. For example, if a hydrogen peroxide solution is used then this may be stabilised by a tetrasodium pyrophosphate.

In a preferred embodiment of the invention only the UV exposure is carried out continuously, followed by a batch bleaching treatment. The UV-irradiated fabric can be stored for several months before bleaching without any reduction in colour yields or anti-pilling properties.

In another embodiment of the invention a fully continuous process using a more rapid oxidant such as PMS may be used. It is also possible to undertake continuous bleaching by use of hydrogen peroxide pad/steam methods.

It is possible to create fine-detailed tone-in-tone effects on prints by placing a suitable stencil between the radiation source and the fabric surface After bleaching, the stencil design is invisible, but after print paste is applied irradiated areas take up more dye and show higher colour yields. Fine meshes, small repeating motifs or stripes can be used effectively to give the impression that a larger number of colours have been used to produce the finished design.

It is also possible to transfer tone-in-tone designs from a compouter to a wool fabric. By using suitable graphic arts software, a complex design or caption can be cut into a thin adhesive PVC film which is opaque to UV radiation. The design is transferred either directly onto the wool fabric or onto a clear polyethylene or polypropylene film (which is transparent to UV down to 220 nm). After exposing the fabric to UV and bleaching, the design can be developed by overprinting a large area with a suitable dye paste.

EXAMPLES

The invention will now be described with reference to some specific examples. Whilst the examples are limited to the treatment of wool fabrics prior to printing, this has been done for convenience and in no way is meant to limit the scope of the invention.

EXAMPLE 1

Pieces of scoured undyed shirting fabric were exposed to short wavelength UV using a low pressure mercury arc (30 W) for periods ranging from 2–30 minutes by wrapping the fabrics around the UV tube. The fabrics were then bleached for one hour at 60° C. using 0.75% w/w hydrogen peroxide solution stabilised by tetrasodium pyrophosphate (0.6% w/w) at pH 8–8.5. After rinsing, drying and steam pressing, the fabric was printed using pastes of the following composition:

| | |
|---|---|
| Indalca PA3, 10% stock solution | 50% |
| dye (e.g. Lanaset Blue 2R) | 2% |
| water | 38% |
| urea | 10% |

Print pastes were prepared using Lanasol Black 5055, Lanasol Scarlet 3 G and Drimarene Turquoise R-BLD dyes.

Test strips were printed using a Johannes Zimmer Sample Printing Machine Type MDK, using two passes of a magnetic squeegee bar.

After printing, fabric was dried at room temperature, steamed at 100° C. for 30 minutes in an autoclave, washed off in warm water and dried. All prints made on irradiated/bleached fabric were visibly more intense than those carried out using untreated, bleached only and UV-exposed only fabric. The reflectance spectra of printed samples was measured, and the reflectance values at the centre of the strongest absorption band were recorded. These were converted to colour yield (K/S) values, which are related to the dye concentration at the surface, using the Kubelka-Munk equation.

The colour yield of UV-treated/peroxide-bleached fabric was significantly higher than that of unirradiated fabric. The colour yields increased with irradiation time as shown in FIG. 1, and in all cases exceeded those for fabric treated with 4% dichloroisocyanuric acid (DCCA) after 30 minutes irradiation.

EXAMPLE 2

A piece fine glass fibre mesh was placed between a low pressure mercury arc and a sample of ecru shirting fabric. The sample was exposed to UV for 40 minutes, followed by peroxide bleaching as described in Example 1. The mesh design was not visible after bleaching, but after printing with Lanasol Black 5055, a fine-detailed black/grey tone-in-tone effect was observed.

EXAMPLE 3

Figure 2:
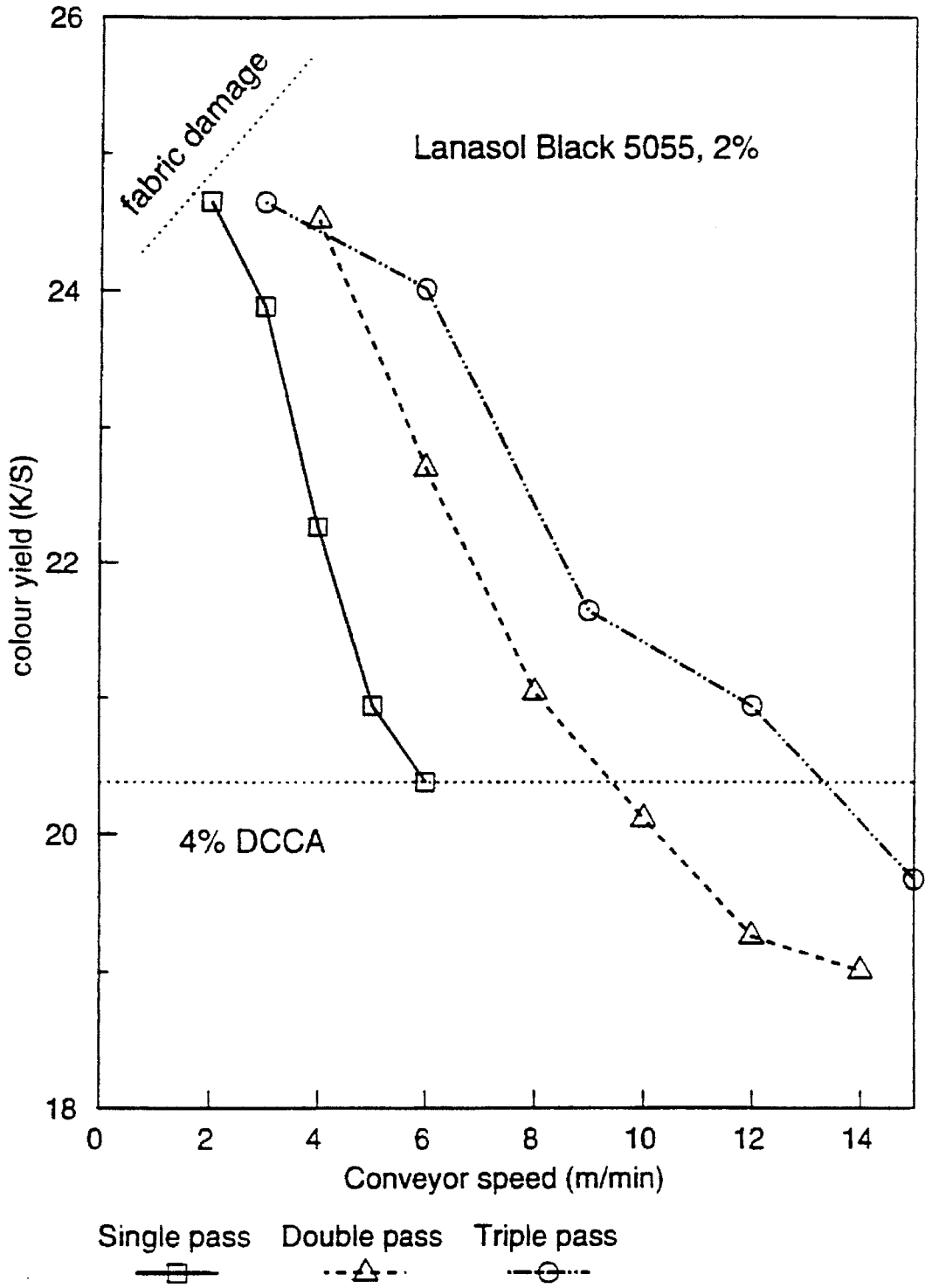
FIG. 2 is a graph comparing color yield with conveyor speed for UV-exposed/bleached fabric.

Scoured ecru wool fabric sampler were placed on a conveyor system and passed below a medium pressure mercury arc the UV radiation from which was focused at the fabric surface using an elliptical reflector. The conveyor speed was varied from 2 to 15 meters per minute, and a single UV source having a power of 120 W/cm was used. Samples were given up to three passes under the UV source over a range of conveyor speeds, to simulate a machine having a series of UV tubes. The fabrics were then bleached, printed with Lanasol Black 5055 and steamed as per Example 1, and the colour yields measured. The colour yields of UV-exposed/bleached fabric varied with conveyor speed as shown in FIG. 2.

The example clearly demonstrates that colour yields better than a 4% DCCA treatment can be achieved using continuous UV irradiation operating at speeds between 2 and 12 meters per minute.

EXAMPLE 4

A company logo was generated using computer graphic arts software and the design was cut into a thin black adhesive PVC film. The design was affixed to a sheet of polyethylene film held taut on an aluminium frame. The frame was held firmly over a piece of wool challis fabric and a bank of low-pressure mercury arcs was positioned over the frame. The frame and fabric were exposed to UV for 40 minutes. The fabric was removed and bleached as described in Example 1. The entire area of the logo was printed with Drimarene Turquoise R-BLD paste, and the print was dried, steamed and washed off normally. Irradiated areas of the printed logo were far more intensely coloured than unexposed areas, and a high-quality tone-in-tone print was obtained.

EXAMPLE 5

Figure 3:
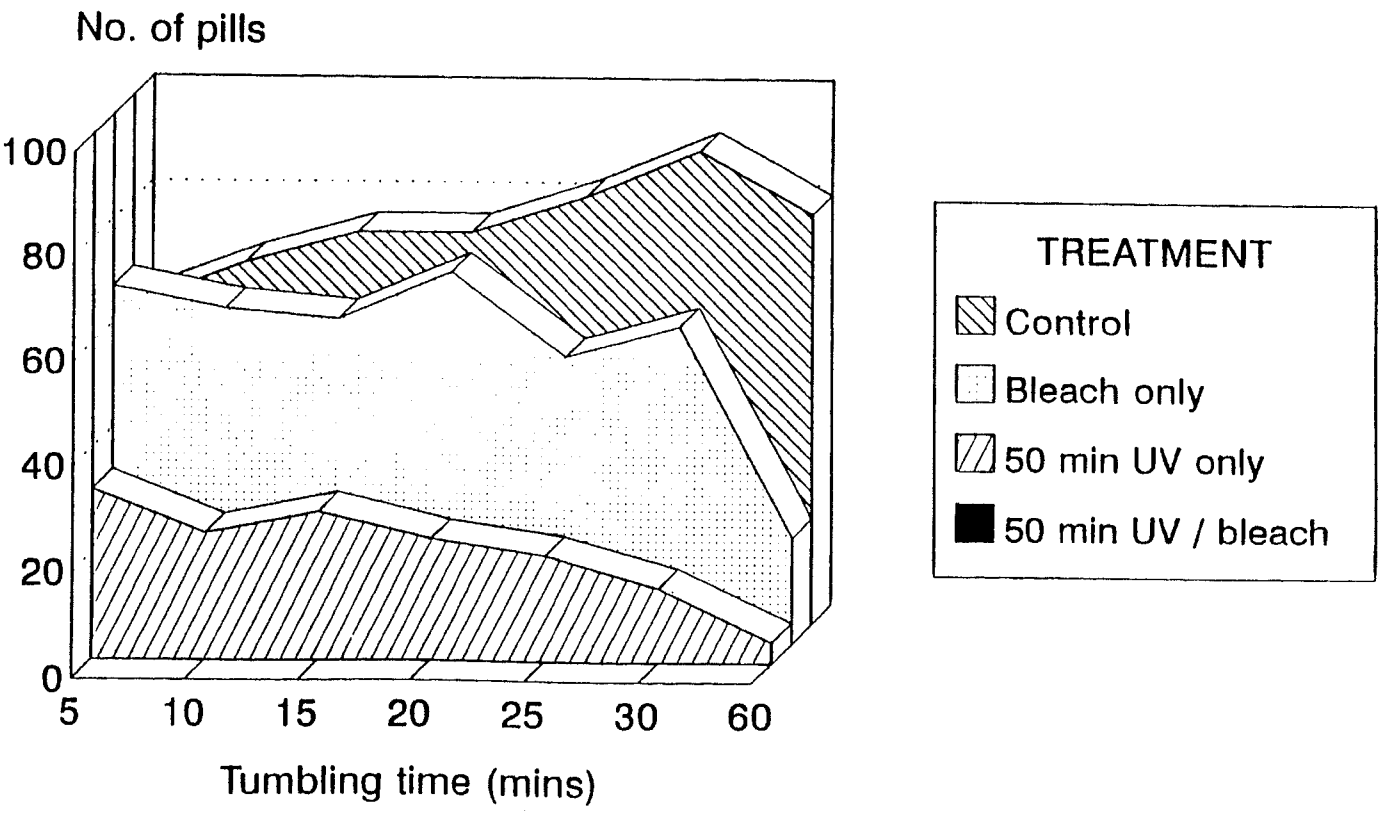
FIG. 3 is a report on pilling performance showing variation in the mean number of pills per sample using ASTM random tumble test D3512-82.

Four groups of three standard pilling samples (double jersey knitted fabric) were prepared. The first group was exposed to UV-C radiation from a bank of eight low-pressure mercury tubes for 50 minutes on both sides. The second group was also exposed to UV using similar conditions, but afterwards the samples were bleached for one hour at 60° C. with hydrogen peroxide (0.75% w/w) stabilised with tetrasodium pyrophosphate (6 g/l) at pH 8–8.5. The samples were rinsed well and allowed to dry. The third group of samples were bleached with peroxide only, and the fourth group of specimens were untreated controls. Pilling performance was measured using an Atlas Random Tumble Pilling Tester (RTPT) using the standard procedure (ASTM D3512-82), with number of pills counted at 5, 10, 15, 20, 25, 30 and 60 minute intervals. FIG. 3 shows the variation in the mean number of pills per sample throughout the pilling test. It is clear that only those samples treated with UV/peroxide bleaching show excellent anti-pilling performance.

EXAMPLE 6

Seven groups of three samples of standard double jersey knitted fabric were prepared. The groups were exposed to UV-C radiation using an irradiator fitted with eight low-pressure germicidal UV tubes for periods of 0, 5, 10, 20, 30, 40 and 50 minutes. All samples were then bleached for one hour at 60° C. with hydrogen peroxide (0.75% w/w) stabilised with tetrasodium pyrophosphate (6 g/l) at pH 8–8.5. The samples were rinsed well in water and allowed to dry.

Figure 4:
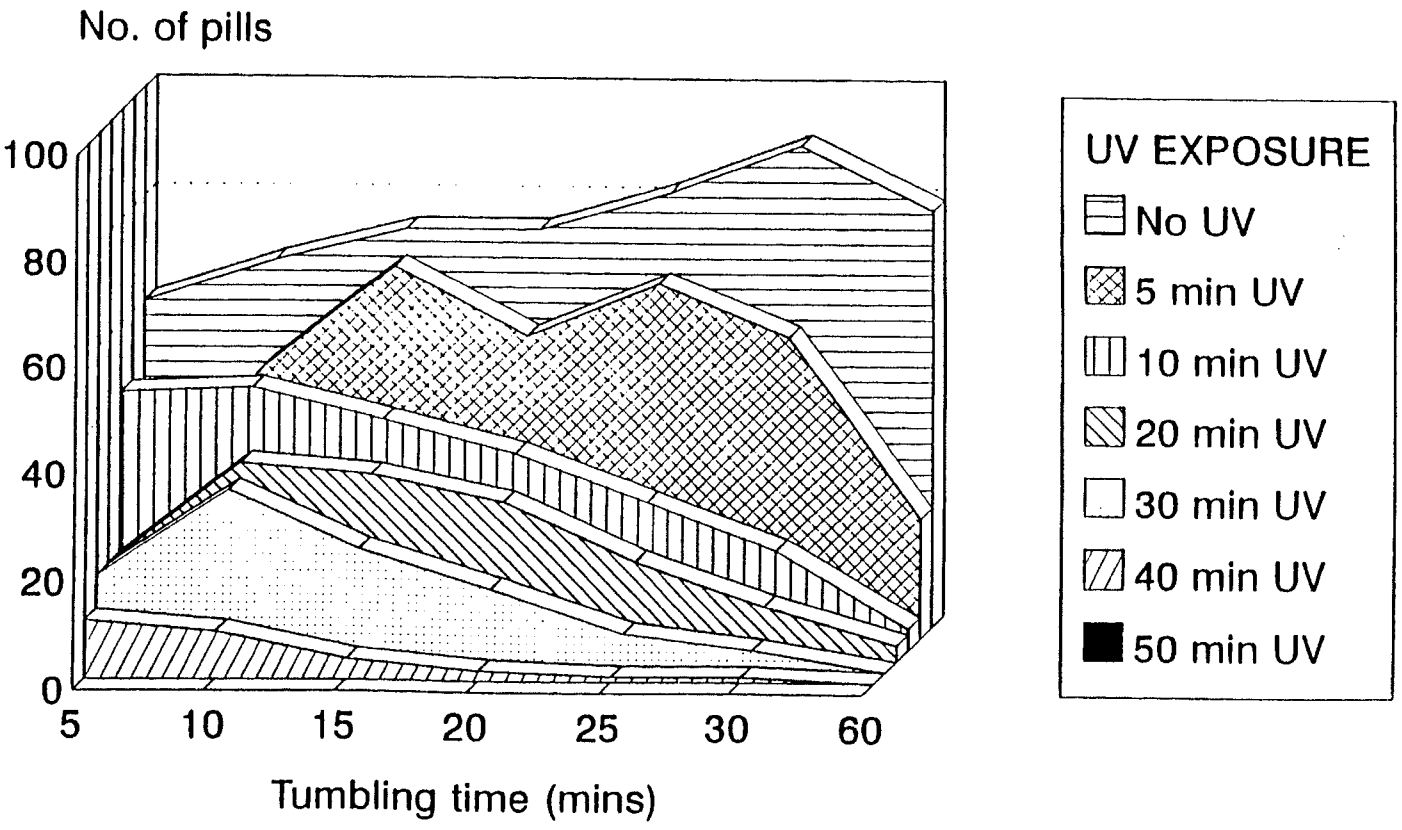
FIG. 4 is a pilling test according to ASTM random tumble test method D3512-82 showing the variation of the mean number of pills observed for samples in each group with tumbling time.

The pilling tests were performed on each group of samples according to the standard ASTM random tumble test method (ASTM D3512-82), with number of pills counted at 5, 10, 15, 20, 25, 30 and 60 minute intervals. FIG. 4 shows the variation of the mean number of pills observed for samples in each group with tumbling time. Clearly the extent of UV irradiation has a dramatic effect on the degree of pilling observed; zero pilling was found throughout the pilling test for all samples irradiated with UV for 50 minutes.

It will be appreciated by persons skilled in the art that numerous variations and/or modifications may be made to the invention without departing from the spirit and scope of the invention as broadly described. The present embodiments are, therefore, to be considered in all respects as illustrative and not restrictive.

I claim:

1. A method of modifying the surface of a wool or wool blend fabric which comprises the successive steps of:

i) exposing the fabric surface to UV radiation; and ii) oxidatively treating the fabric by exposing the fabric to an aqueous oxidative solution.

2. A method according to claim 1 wherein the fabric is exposed to UV radiation in the range of 400–180 nm.

3. A method according to claim 2 wherein the fabric is exposed to UV radiation in the range of 280–200 nm.

4. A method according to claim 1 wherein the fabric is exposed to UV radiation for a time period in the range of a few seconds to 2 hours.

5. A method according to claim 1 wherein in step i) the fabric is exposed to UV radiation through a stencil.

6. A method according to claim 5 wherein the stencil is generated using computer graphic arts software to produce a stencil having UV-transparent and UV-opaque components.

7. A method according to claim 1 wherein the oxidative solution comprises hydrogen peroxide or permonosulfuric acid.

8. A method according to claim 5 wherein the fabric is bleached by an oxidative solution of 0.75% w/w hydrogen peroxide and having a pH in the range 8–9.

9. A method according to claim 1 wherein the oxidative solution is stabilized by tetrasodium pyrophosphate.

10. A method according to claim 1 wherein step i) is carried out continuously.

11. A method according to claim 1 wherein step ii) is carried out in batch mode.

12. The method of claim 1, wherein after said step i) the fabric has a pale yellow color.

13. The method of claim 1, wherein said method reduces fabric pilling.

14. The method of claim 1, wherein said fabric surface is exposed to UV radiation for about 40 to 60 min.

* * * * *